US008177444B2

(12) United States Patent
Wincent

(10) Patent No.: US 8,177,444 B2
(45) Date of Patent: May 15, 2012

(54) PRINTER AND ASSOCIATED EJECTION ASSEMBLY

(75) Inventor: Karl Tommy Wincent, Vaxholm (SE)

(73) Assignee: ZIH Corp., Hamilton (BM)

( * ) Notice: Subject to any disclaimer, the term of this patent is extended or adjusted under 35 U.S.C. 154(b) by 1138 days.

(21) Appl. No.: 11/970,700

(22) Filed: Jan. 8, 2008

(65) Prior Publication Data

US 2009/0175671 A1 Jul. 9, 2009

(51) Int. Cl.
*B41J 11/00* (2006.01)

(52) U.S. Cl. ..... 400/621; 400/611

(58) Field of Classification Search ..... 400/621
See application file for complete search history.

(56) References Cited

U.S. PATENT DOCUMENTS

| | | | | | |
|---|---|---|---|---|---|
| 3,466,959 | A | | 9/1969 | Wharton | |
| 3,856,387 | A | * | 12/1974 | Wray et al. | 352/5 |
| 3,944,212 | A | * | 3/1976 | Stange et al. | 271/65 |
| 4,074,797 | A | | 2/1978 | Lewis et al. | |
| 4,364,552 | A | | 12/1982 | Besemann | |
| 4,544,293 | A | | 10/1985 | Cranston et al. | |
| 4,679,953 | A | * | 7/1987 | Sone et al. | 400/625 |
| 5,041,845 | A | | 8/1991 | Ohkubo et al. | |
| 5,184,533 | A | | 2/1993 | Golicz | |
| 5,330,316 | A | | 7/1994 | Buckman et al. | |
| 5,412,407 | A | | 5/1995 | Okubo et al. | |
| 5,482,389 | A | | 1/1996 | Bickoff et al. | |
| 5,671,065 | A | * | 9/1997 | Lee | 358/304 |
| 6,026,723 | A | | 2/2000 | Sakai | |
| 6,095,007 | A | | 8/2000 | Brewington et al. | |
| 6,182,550 | B1 | | 2/2001 | Brewington et al. | |
| 6,249,295 | B1 | * | 6/2001 | Kiyohara et al. | 346/134 |
| 6,419,222 | B1 | * | 7/2002 | Morrison et al. | 271/186 |
| 6,439,454 | B1 | | 8/2002 | Masson et al. | |
| 6,504,331 | B1 | | 1/2003 | Longrod | |
| 6,684,743 | B1 | | 2/2004 | Brewington et al. | |
| 7,830,564 | B2 | * | 11/2010 | Harada et al. | 358/504 |
| 2001/0008596 | A1 | * | 7/2001 | Mogi | 400/578 |
| 2003/0126962 | A1 | * | 7/2003 | Bland et al. | 83/13 |

FOREIGN PATENT DOCUMENTS

| | | | |
|---|---|---|---|
| JP | 0332868 | A | 2/1991 |
| JP | 2001-199111 | A | 7/2001 |
| JP | 2006-327762 | * | 12/2006 |

* cited by examiner

*Primary Examiner* — Anthony Nguyen
(74) *Attorney, Agent, or Firm* — Alston & Bird LLP

(57) ABSTRACT

An ejection assembly for a printer is provided, the ejection assembly being disposed downstream of a print head in order to receive web from the print head. The ejection assembly can include an ejection roller and a door having a closed configuration and an open configuration. The door can be biased toward the closed configuration and toward the ejection roller. Upon rotation of the ejection roller, the ejection roller can force the door from the closed configuration to the open configuration and can eject web past the door from the printer. In some embodiments, the ejection roller is rotated one full cycle, the ejection roller permits accumulation of web received from the print head and subsequently forces the door from the closed configuration to the open configuration and ejects the accumulated web past the door from the printer. Also provided are a corresponding printer and method.

9 Claims, 6 Drawing Sheets

PRINTER AND ASSOCIATED EJECTION ASSEMBLY

BACKGROUND OF THE INVENTION

1. Field of the Invention

Embodiments of the present invention relate generally to printers, ejection assemblies, and methods of cycling a printer through printing, cutting, and ejecting stages of operation.

2. Description of Related Art

A variety of applications exist for publicly-used, stand-alone printers, or so-called "kiosk printers." These include the printing of receipts at gas pumps and automatic teller machines (ATMs), amongst others. Commonly, kiosk printers advance a web of continuous print media through the printer for printing, cut the media in order to separate an individual printed portion of the web, and present the cut web portion for receipt by a user. In order to accomplish all of these operations, kiosk printers will often include multiple motors and a variety of parts associated with each motor. As such, kiosk printers tend to be complicated and expensive.

BRIEF SUMMARY OF THE INVENTION

In one aspect, a printer is provided that includes a print head and a bi-directional motor structured to rotate in opposing first and second directions. A drive roller is coupled to the bi-directional motor for advancing a web toward the print head upon rotation of the bi-directional motor in the first direction. A cutter is coupled to the bi-directional motor for cutting web upon rotation of the bi-directional motor in the second direction. An ejection roller is also coupled to the bi-directional motor, the ejection roller acting to eject the web at least partially from the printer in conjunction with being cut by the cutter. For example, the ejection roller can be configured to eject web at least partially from the printer upon rotation of the bi-directional motor in the second direction and subsequent to being cut by the cutter. The ejection roller can define a rotational axis and a cross sectional shape having a non-uniform radius as measured from the rotational axis. For example, the ejection roller can define a D-shaped cross section. The printer may further include a door having a closed position and an open position. The door can be biased in the closed position and disposed proximate the ejection roller. The non-uniform cross sectional shape of the ejection roller can define a maximum radius as measured from the rotational axis, and the door can be forced into the open position by the ejection roller when the door is contacted by an area of the ejection roller disposed generally proximate the maximum radius of the ejection roller. For example, the ejection roller may be D-shaped and may include a circular web-gripping region that forces the door from the closed configuration to at least a partially opened position.

In some embodiments, rotation of the bi-directional motor in the first direction operates to advance the web toward the print head and collect a portion of the web downstream of the print head. Rotation of the bi-directional motor in the second direction may operate to cut and eject from the printer at least part of the portion of the web collected downstream of the print head. The printer can also include a door that is at least partially opened by the ejection roller as the ejection roller ejects the at least part of the collected web portion. The door may be biased in a closed position and/or may maintain the web against the ejection roller as the ejection roller ejects at least part of the web. In other embodiments, the printer may include a drive shaft coupled to the bi-directional motor. A first one-way clutch can be mounted to the drive shaft and coupled to the drive roller, the first one-way clutch being adapted to rotate the drive roller when the drive shaft is rotated in the first direction by the bi-directional motor. A second one-way clutch can be mounted to the drive shaft and coupled to the ejection roller, the second one-way clutch being adapted to rotate the ejection roller when the drive shaft is rotated in the second direction by the bi-directional motor.

In another aspect, an ejection assembly for a printer is provided, the ejection assembly being disposed downstream of a print head in order to receive web from the print head. The ejection assembly can include an ejection roller and a door having a closed configuration and an open configuration. The door can be biased toward the closed configuration and toward the ejection roller. For example, the door can include a resilient member biased toward the closed configuration. Upon rotation of the ejection roller, the ejection roller can force the door from the closed configuration to the open configuration and can eject web past the door from the printer. For example, the ejection roller can rotate about a rotational axis that is stationary relative to the printer, and the ejection roller may intermittently force the door from the closed configuration as the ejection roller rotates about the stationary rotational axis. In some embodiments, the flexible member may maintain the web against the ejection roller as the ejection roller ejects the web from the printer. In other embodiments, the ejection roller is rotated one full cycle, the ejection roller permits accumulation of web received from the print head and subsequently forces the door from the closed configuration to the open configuration and ejects the accumulated web past the door from the printer.

In yet another aspect, a method of cycling a printer through printing, cutting, and ejecting stages of operation is provided. The method includes rotating a bi-directional motor in a rotational first direction, causing a drive roller to rotate proximal a print head. The bi-directional motor can be rotated in a rotational second direction opposite the first direction, causing a web cutter to actuate. The bi-directional motor can be rotated further in the second direction, causing an ejection roller to rotate and open a web ejection door.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

The present invention now will be described more fully hereinafter with reference to the accompanying drawings, in which some, but not all embodiments of the inventions are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Figure 1:
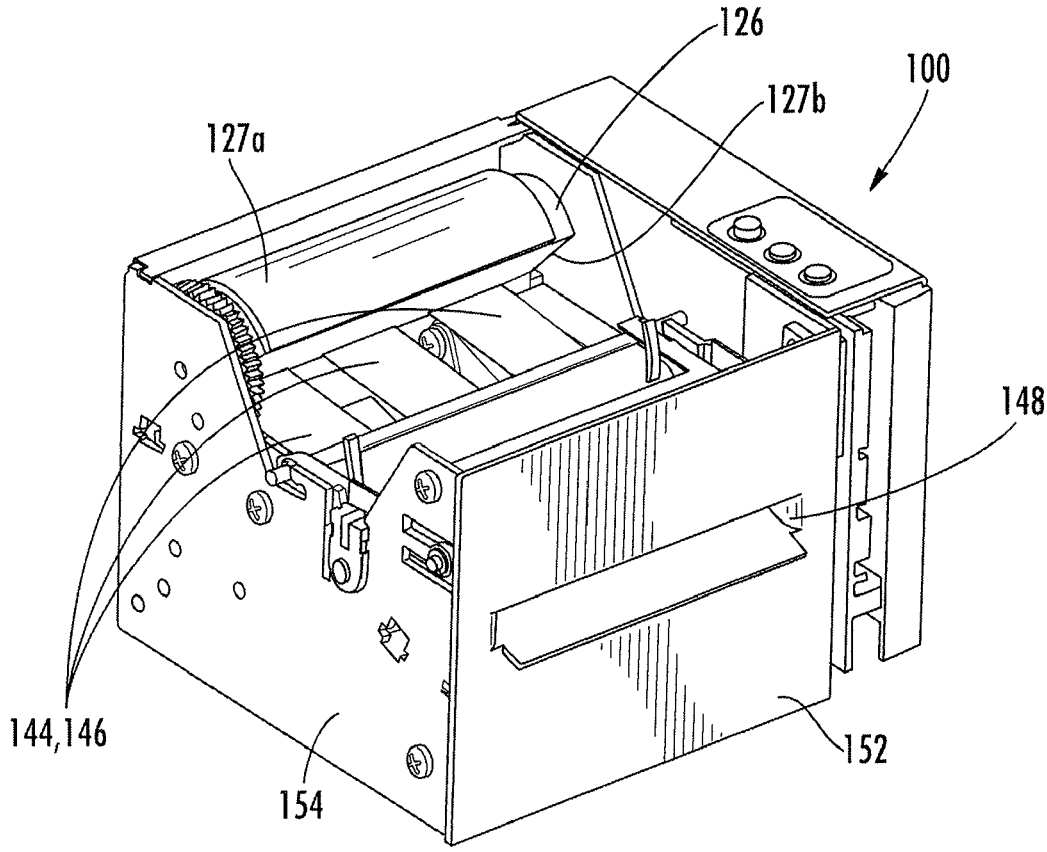
FIG. 1 is a perspective view of a printer configured in accordance with an exemplary embodiment, showing the media inlet of the printer.
Figure 2:
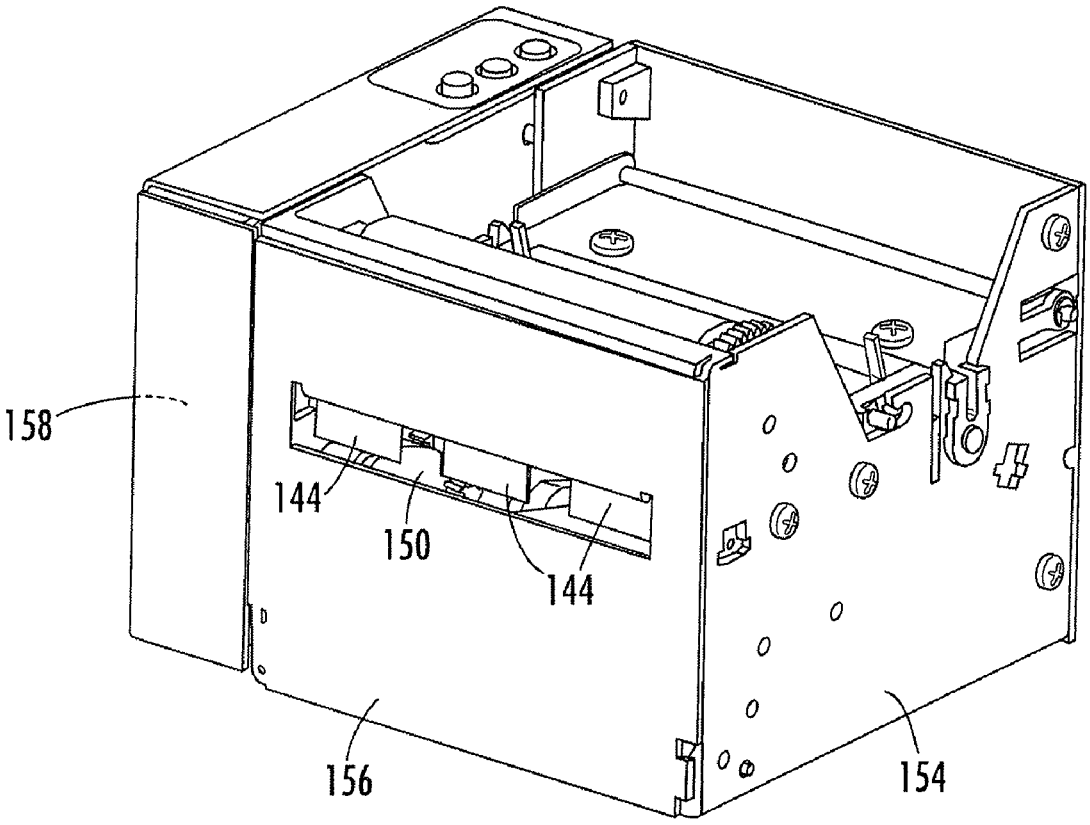
FIG. 2 is a perspective view of the printer of FIG. 1, showing the media outlet of the printer and the door in the closed position.
Figure 3:
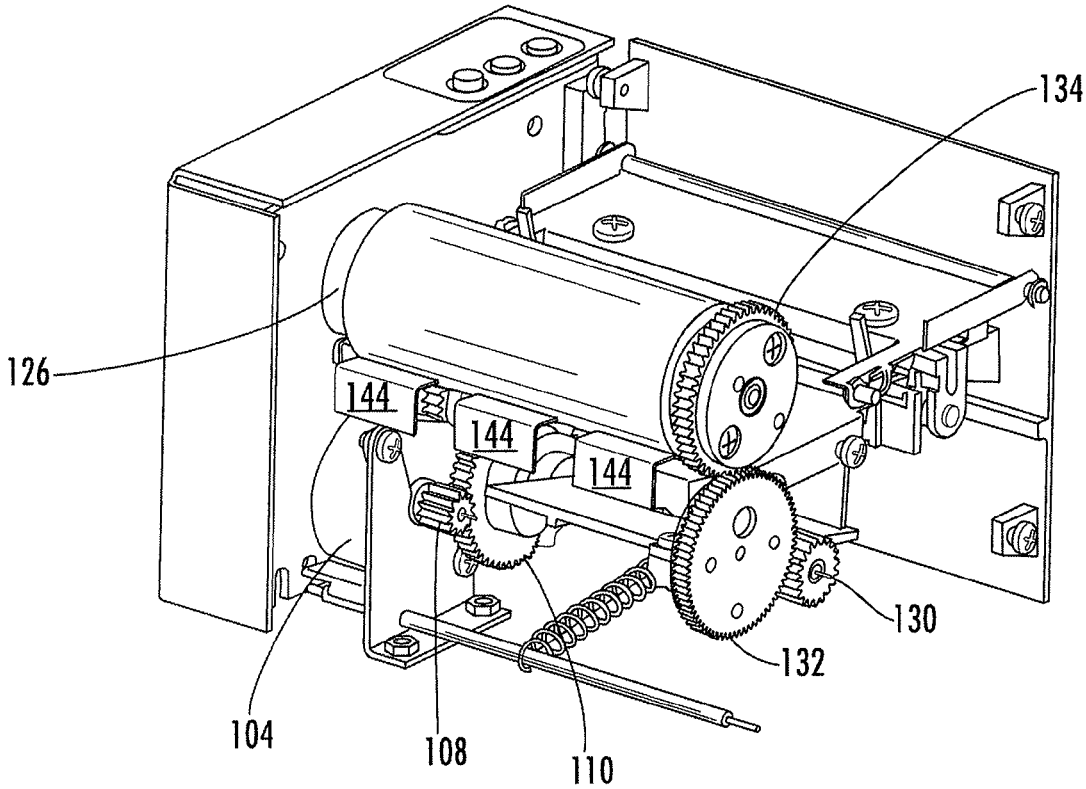
FIG. 3 is a perspective view of the printer of FIG. 1 with several sides removed to reveal the components contained therein.
Figure 4:
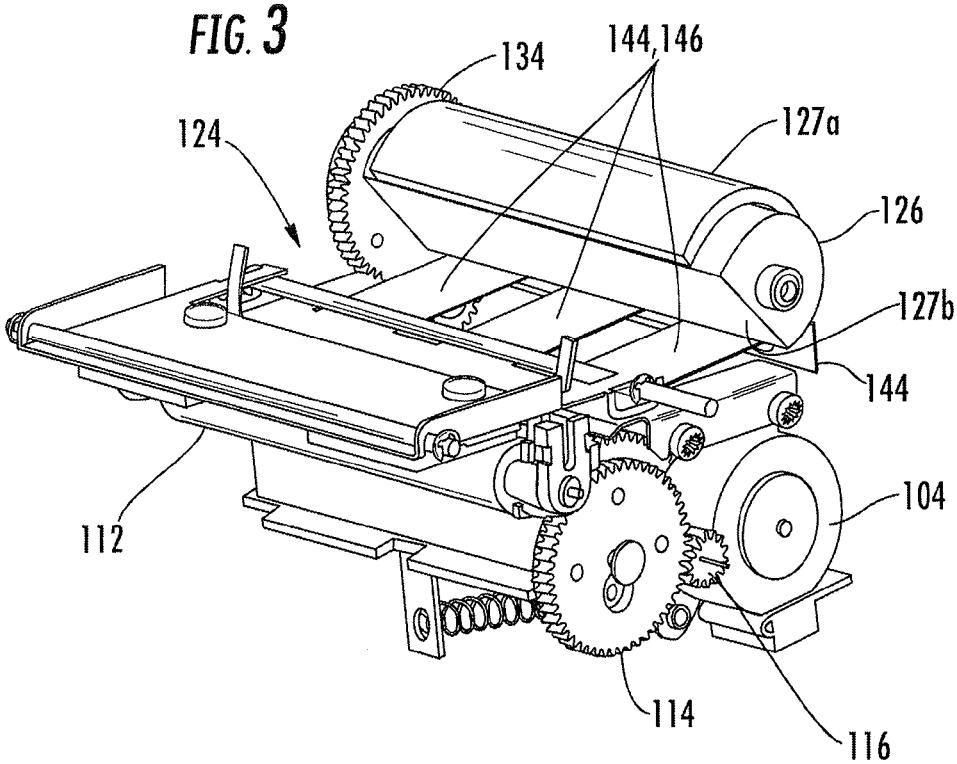
FIG. 4 is a perspective view of the printer of FIG. 1 with all sides removed.
Figure 5:
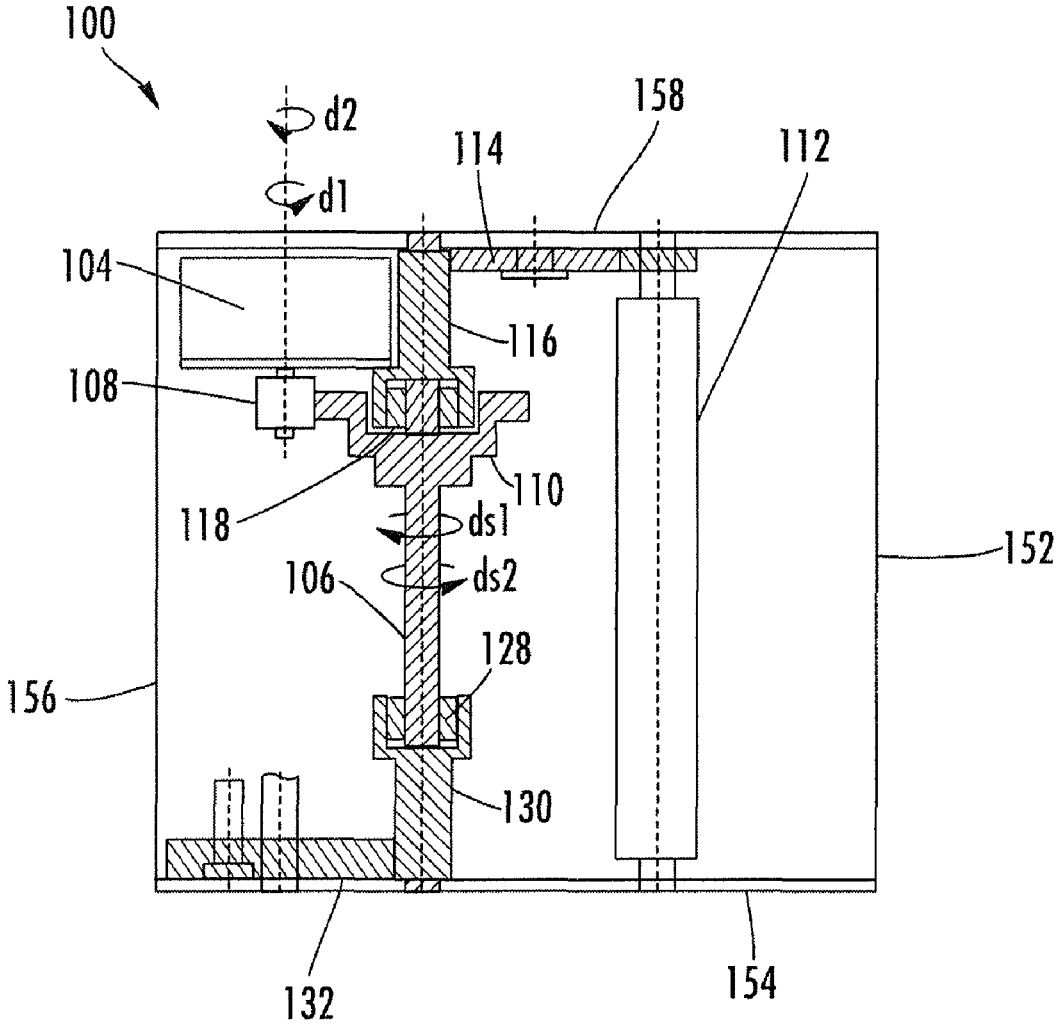
FIG. 5 is a cross-sectional plan view of the internal components of the printer of FIG. 1.
Figure 6:
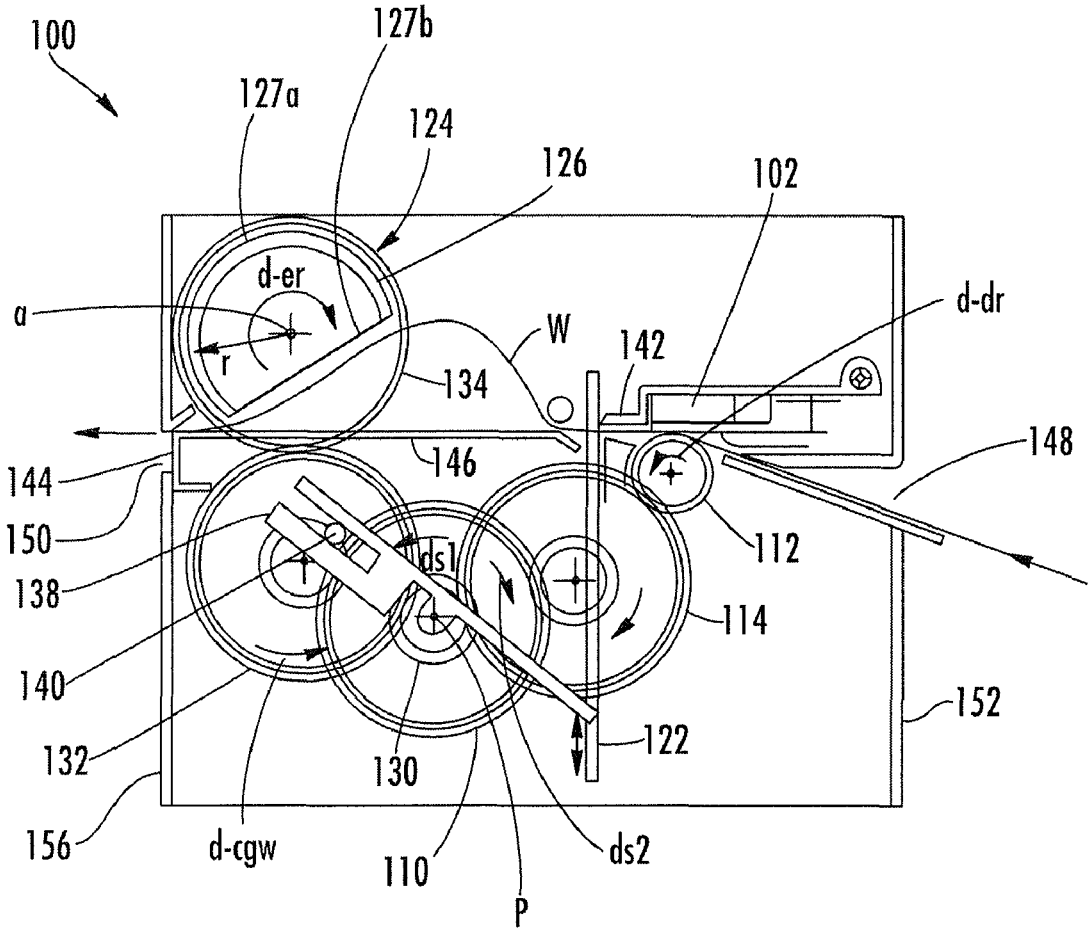
FIG. 6 is a cross-sectional side view of the printer of FIG. 1.
Figure 7:
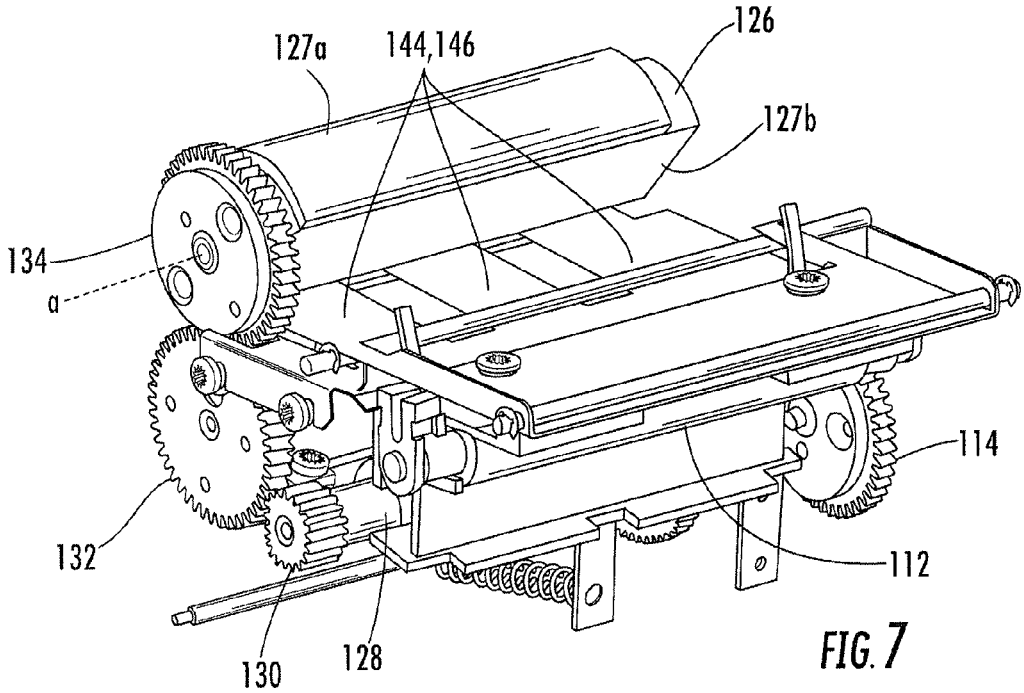
FIG. 7 is a perspective view of the printer of FIG. 1 with all sides removed.
Figure 8:
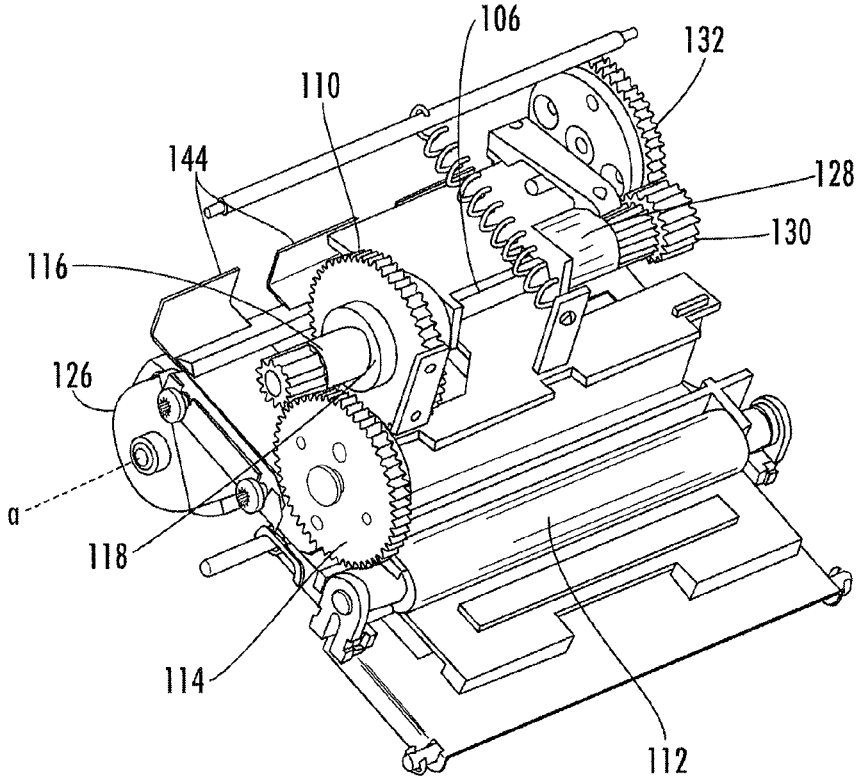
FIG. 8 is a perspective view of the underside of the printer of FIG. 1.

FIGS. 1-8 depict a printer 100 configured in accordance with an exemplary embodiment. The printer 100 has an outer casing that includes various side panels 152, 154, 156, 158 that serve to protect internal printer components, which components are described below. The side panels 152, 156 also serve to define a printer inlet 148 and a printer outlet 150, respectively. The functions of the inlet 148 and outlet 150 are discussed later.

The printer 100 includes a print head 102, which serves to apply markings to a print medium being processed (i.e., printed on) by the printer. For example, the print head 102 may apply ink to the print media, or may transfer thermal energy to the print media in order to produce the markings. Also included is a bi-directional motor 104 structured to rotate in opposing first and second directions, d1 and d2. An example of a type of motor that might be appropriate for use as the bi-directional motor 104 is a stepper motor. The bi-directional motor 104 can be coupled to a drive shaft 106 via a motor gear wheel 108 that mates with a drive shaft gear wheel 110. This allows the bi-directional motor 104 to rotate the drive shaft 106 in a first drive shaft direction ds1 (corresponding to the first direction d1) and a second drive shaft direction ds2 (corresponding to the second direction d2). A drive roller 112 is coupled to the bi-directional motor 104, for example, through a drive roller gear wheel 114 that mates with a first intermediate gear wheel 116. The intermediate gear wheel 116 includes a first clutch 118 that can be disengaged from the drive shaft 106, thereby allowing the intermediate gear wheel and drive shaft to rotate independently of one another. When the bi-directional motor 104 actuates in a first of the two possible actuation directions and the first clutch 118 is engaged, rotation of the drive shaft 106 causes corresponding rotation of the drive roller 112, which in turn advances a web w toward the print head 102.

Also coupled to the bi-directional motor 104 are a cutter 122 and an ejection assembly 124 including an ejection roller 126, all of which are configured to operate when the bi-directional motor moves in the second direction d2. For example, the cutter 122 and ejection assembly 124 can be coupled to the bi-directional motor 104 through a second clutch 128 (when engaged) and second gear wheel 130. The second gear wheel 130 can mate with a cutter gear wheel 132, which then couples to an ejection roller gear wheel 134.

The cutter 122 can be coupled to the cutter gear wheel 132 via a cutter drive arm 138 and a cutter drive pin 140. The cutter drive pin 140 is fixed to the cutter gear wheel 132 and the cutter drive arm 138 is rotationally secured at a point p that is displaced from the cutter drive pin, and as the cutter gear wheel rotates, the cutter drive pin causes the cutter drive arm to rotate about the point p. This motion of the cutter drive arm 138 in turn causes the cutter 122 to undergo oscillatory translations that, in conjunction with a stationary blade 142, serve to cut the web w.

The ejection roller 126 is coupled to the ejection roller gear wheel 134, and as the bi-directional motor operates in the second direction d2, the ejection roller rotates with the ejection roller gear wheel. The ejection roller 126 can be configured such that as the ejection roller rotates, it acts to eject web at least partially from the printer 100 in conjunction with being cut by the cutter 122. The ejection roller 126 may define a rotational axis a and a cross sectional shape having a non-uniform radius as measured from the rotational axis a. For example, the ejection roller 126 can define a D-shaped cross section with a circular web-gripping region 127*a* having a maximum radius r (measured from the axis a) and a flat region 127*b* having a radius that is less than r. In some cases, the D-shaped cross section may facilitate the ejection of web from the printer 100 by the ejection roller 126, as discussed further below.

The ejection assembly 124 can also include a door 144 having a closed position and an open position, for example, with respect to a media outlet 150. The door 144 can be biased in the closed position, such that the media outlet 150 is obstructed by the door and an application of force is necessary to move the door into the open position. For example, the door 144 can include a cantilevered spring plate 146 or other resilient member that is directed in a closed position. Additionally, the door 144 can be disposed proximate the ejection roller 126, thereby allowing the rotational movement of the ejection roller to provide the opening force for the door. For example, in cases where the ejection roller 126 has a non-uniform cross sectional shape that defines a maximum radius r and the door 144 includes the spring plate 146, the ejection roller and door can be disposed such that rotation of the ejection roller causes the portion of the ejection roller with the maximum radius r to contact the door near the free end of the spring plate and urge the door into the open position. As the ejection roller 126 continues to rotate, the portion of the ejection roller with the maximum radius r moves past and eventually loses contact with the door 144, and the door returns to the closed position.

As mentioned above, when the bi-directional motor 104 is actuating in a first direction and the first clutch 118 is engaged, rotation of the drive shaft 106 causes corresponding rotation of the drive roller 112, which in turn advances the web w toward the print head 102. The web w may continue past (i.e., downstream of) the print head 102 and toward the ejection roller 126 and between the ejection roller and the door 144, where the web can be collected. If the motor 104 is then operated in the second direction, the ejection roller 126 may then act to at least partially eject the web w from the printer 100 as the ejection roller forces open the door 144. In some embodiments, the door 144 can maintain the web w against the ejection roller 126 as the ejection roller ejects at least part of the web, as in the case where the door includes the spring plate 146 that compresses the web against the ejection roller when the ejection roller contacts the door.

As mentioned, the drive shaft 106 can be respectively coupled to the drive roller 112 and the ejection roller 126 through the first and second clutches 118, 128 that are mounted to the drive shaft. In some embodiments, the first and second clutches 118, 128 can be one-way clutches, such that the first clutch 118 can only be engaged when the motor 104 actuates in the first direction d1 and the second clutch 128 can only be engaged when the motor actuates in the second direction d2. When the first and second clutches 118, 128 are so configured, rotation of the bi-directional motor 104 in the first direction operates the drive roller 112 while the cutter 122 and ejection assembly 124 are idle, and rotation of the bi-directional motor in the second direction operates the cutter 122 and ejection assembly 124 while the drive roller 112 is idle. Overall, the printer 100 can advance the web w toward the print head 102 and collect a portion of the web downstream of the print head when the motor 104 actuates in the first direction, and can cut and eject the web portion from the printer when the bi-directional motor actuates in the second direction.

During the operation of embodiments employing one-way first and second clutches 118, 128 and a D-shaped ejection roller 126, web w enters the printer 100 through the media inlet 148. For example, a web or media supply can be located beyond the media inlet 148 that supplies web to the inlet. The bi-directional motor 104 moves in the first direction d1 and the drive roller 112 rotates in the direction d-dr, the web w is transported by the drive roller to the print head 102, for example, in order to be printed on by the print head. At the same time, because the clutches 118, 128 are one-way clutches and oriented in opposing directions, the cutter 122 and ejection assembly 124 remain idle. The web w is driven further forward (perhaps for printing on another portion of the web), such that some of the web (e.g., a portion on which printing has already occurred) moves past the print head 102 and into an area downstream of the print head that is between the ejection roller 126 and the door 144. The web w is collected in this area until the motor 104 discontinues operation in the first direction d1 (e.g., when a print operation is completed).

The motor 104 can then be operated in the second direction d2, thereby causing the drive shaft 106 to rotate in the second drive shaft direction ds2 and initiating operation of the cutter 122 and ejection assembly 124 (the drive roller 112 being idle). The cutter gear wheel 132 rotates in the direction d-cgw causing the cutter 122 to cut the web. The rotation of the cutter gear wheel 132 also causes the ejection roller 126 and associated ejection roller gear wheel 134 to rotate in the direction d-er. As the ejection roller 126 rotates, the circular region 127*a* contacts the portion of the web w that was cut by the cutter 122, and compresses this web portion against the door 144. Further rotation of the ejection roller 126 moves the web w towards and through the media outlet 150 as the door 144 is simultaneously forced open by the circular region 127*a* of the ejection roller. The ejection roller 126 continues to rotate until the circular region 127*a* of the ejection roller has moved past the orientation at which it is directed toward the door 144, at which point the door gradually moves toward the closed position. As the door 144 closes, the web w is further ejected from the printer 100. While the ejection roller 126 in this way acts to at least partially eject the web w from the printer 100, a portion of the web may be retained by the printer by being compressed between the ejection roller and the door 144.

It is noted that the gear ratios between the second gear wheel 130, the cutter gear wheel 132, the ejection roller gear wheel 134, and the transfer gear wheel 136 can be adjusted in order to cause the various gear wheels (and related components) to rotate at different relative angular velocities. As such, the printer 100 can be designed to allow the cutter 122 to cut the web w before the ejection roller 126 acts to eject the web, such that rotation of the bi-directional motor 104 in the second direction causes a web cutter to actuate and cut web and further rotation of the bi-directional motor in the second direction causes an ejection roller to rotate and open the door 144. Further, the geometry of the ejection roller 126 can be modified to affect the timing of cutting and web ejection operations.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A printer comprising:

a bi-directional motor structured to rotate in opposing first and second directions;

a print head;

a drive shaft coupled to the bi-directional motor;

a first one-way clutch mounted to the drive shaft;

a drive roller coupled to the first one-way clutch, wherein the drive roller advances a web toward the print head upon rotation of the bi-directional motor in the first direction;

a second one-way clutch mounted to the drive shaft;

a cutter coupled to the second one-way clutch for cutting the web upon rotation of the bi-directional motor in the second direction;

an ejection roller coupled to the second one-way clutch, wherein the ejection roller defines a rotational axis and a cross sectional shape having a non-uniform radius as measured from the rotational axis, wherein the non-uniform cross sectional shape of the ejection roller defines a maximum radius as measured from the rotational axis, and wherein the ejection roller ejects the web at least partially from the printer in conjunction with the web being cut by the cutter when the drive shaft is rotated in the second direction by the bi-directional motor; and a door having a closed position and an open position, wherein the door is biased in the closed position and disposed proximate the ejection roller, and wherein the door is forced into the open position by the ejection roller when the door is contacted by an area of the ejection roller disposed generally proximate the maximum radius of the ejection roller.

2. A printer according to claim 1, wherein the ejection roller defines a D-shaped cross section.

3. A printer according to claim 1, wherein rotation of the bi-directional motor in the first direction operates to advance the web toward the print head and collect a portion of the web downstream of the print head, and rotation of the bi-directional motor in the second direction operates to cut and eject from the printer at least part of the portion of the web collected downstream of the print head.

4. A printer according to claim 3, wherein the door that is at least partially opened by the ejection roller as the ejection roller ejects the at least part of the collected web portion.

5. A printer according to claim 4, wherein the door maintains the web against the ejection roller as the ejection roller ejects at least part of the web.

6. A printer according to claim 1, wherein said ejection roller is configured to eject web at least partially from the printer upon rotation of the bi-directional motor in the second direction and subsequent to being cut by the cutter.

7. A printer comprising:

a bi-directional motor structured to rotate in opposing first and second directions;

a print head;

a drive roller coupled to the bi-directional motor for advancing a web toward the print head upon rotation of the bi-directional motor in the first direction;

a cutter coupled to the bi-directional motor for cutting web upon rotation of the bi-directional motor in the second direction;

an ejection roller coupled to the bi-directional motor for ejecting web at least partially from the printer in conjunction with being cut by the cutter, wherein the ejection roller defines a rotational axis and a cross sectional shape having a non-uniform radius as measured from the rotational axis; and a door having a closed position and an open position, wherein the door is biased in the closed position and disposed proximate the ejection roller, wherein the non-uniform cross sectional shape of the ejection roller defines a maximum radius as measured from the rotational axis, and wherein the door is forced in to the open position by the ejection roller when the door is contacted by an area of the ejection roller disposed generally proximate the maximum radius of the ejection roller.

8. A printer according to claim 7, wherein the ejection roller defines a D-shaped cross section.

9. A printer according to claim 7, wherein rotation of the bi-directional motor in the first direction operates to advance the web toward the print head and collect a portion of the web downstream of the print head, and rotation of the bi-directional motor in the second direction operates to cut and eject from the printer at least part of the portion of the web collected downstream of the print head.

* * * * *